United States Patent [19]

Tanabe

[11] 4,311,895

[45] Jan. 19, 1982

[54] COOKING UTENSIL CONTROLLED BY GAS SENSOR OUTPUT

[75] Inventor: Takeshi Tanabe, Osaka, Japan

[73] Assignee: Sharp Kabushiki Kaisha, Osaka, Japan

[21] Appl. No.: 71,179

[22] Filed: Aug. 31, 1979

[30] Foreign Application Priority Data

Sep. 5, 1978 [JP] Japan ..... 53/109404
Dec. 19, 1978 [JP] Japan ..... 53/158008
Dec. 20, 1978 [JP] Japan ..... 53/159626

[51] Int. Cl.[3] ..... H05B 6/68

[52] U.S. Cl. ..... 219/10.55 B; 219/497; 99/325; 236/46 A; 340/634; 426/243

[58] Field of Search ..... 219/10.55 R, 10.55 B, 219/10.55 E, 492, 497; 99/325; 236/46 A, 46 D, 15 E; 426/243; 340/632, 633, 634

[56] References Cited

U.S. PATENT DOCUMENTS 3,839,616 10/1974 Risman ..... 219/10.55 R
4,080,564 3/1978 Nitta et al. ..... 219/10.55 B X
4,097,707 6/1978 Kobayashi et al. ..... 219/10.55 B
4,162,381 7/1979 Buck ..... 426/243 X
4,187,542 2/1980 Ball et al. ..... 236/15 E
4,213,023 7/1980 Satoh et al. ..... 219/10.55 B

FOREIGN PATENT DOCUMENTS 52-13150 2/1977 Japan ..... 219/10.55 B

OTHER PUBLICATIONS

*Radio Electronics*, vol. 47, No. 7, pp. 46–47, Jul. 1976; "Build a Gas Sensor", By C. R. Lewart.

*Primary Examiner*—Gene Z. Rubinson
*Assistant Examiner*—Keith E. George
*Attorney, Agent, or Firm*—Birch, Stewart, Kolasch and Birch

[57] ABSTRACT

A combined microwave and electric heating cooking apparatus comprising a magnetron for microwave cooking purposes, a sheath heater for electric heating cooking purposes, and a cooking control circuit for controlling operations of the magnetron and the sheath heater. A gas sensor is disposed in an exhaustion gas path for detecting the concentration of the gas generated from a foodstuff. When an output signal of the gas sensor indicates that the gas concentration reaches a preselected value, the cooking control circuit develops a control signal for terminating the cooking. Selection switches are provided for determining the above-mentioned preselected value in accordance with the kind of the foodstuff to be cooked.

10 Claims, 6 Drawing Figures

COOKING UTENSIL CONTROLLED BY GAS SENSOR OUTPUT

BACKGROUND AND SUMMARY OF THE INVENTION

The present invention relates to a cooking utensil and, more particularly, to a control circuit responding to an output signal derived from a gas sensor in a cooking utensil, for example, a microwave oven.

Recently, a combined microwave and electric heating cooking oven has been developed. In such a cooking oven it is very difficult to determine a preferred cooking time period. The cooking time period must be determined in accordance with the kind of foodstuff to be cooked, the initial condition of the foodstuff, the amount of the foodstuff, the output energy level of the cooking apparatus, the environment condition, etc.

One approach is to detect the food temperature or the oven temperature to control the microwave generation or the heater energization. However, the temperature responsive control is not perfectly satisfactory.

Accordingly, an object of the present invention is to provide a novel control system for a cooking utensil.

Another object of the present invention is to provide a combined microwave and electric heating cooking oven including a gas sensor and a control circuit responding to an output signal derived from the gas sensor.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects pursuant to an embodiment of the present invention, a gas sensor is disposed in a path of the gas exhausted from an oven cavity. A control circuit is provided for terminating the microwave generation or the heater energization when an output voltage signal of the gas sensor reaches a preselected value.

A plurality of selection switches are provided for determining the above-mentioned preselected value, at which the control circuit responds, in accordance with the kind of foodstuff to be cooked. More specifically, the selection switches are associated with resistors for selecting the preselected value by dividing an output voltage level of the gas sensor in an initial condition.

The present control is based on the fact that the concentration of the gas developed from the foodstuff being cooked reaches a predetermined value when the foodstuff has been cooked. The predetermined value of the gas concentration varies in a fashion depending on the kind of foodstuff being cooked. The output voltage signal of the gas sensor represents the gas concentration and, therefore, the completion of the cooking can be detected by detecting whether the gas sensor output reaches the preselected value.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
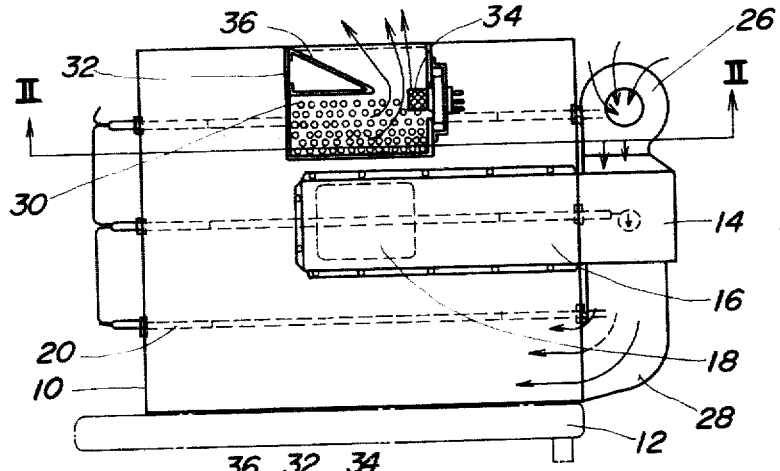
FIG. 1 is a schematic plan view of an embodiment of a combined microwave and electric heating cooking apparatus including a gas sensor.
Figure 2:
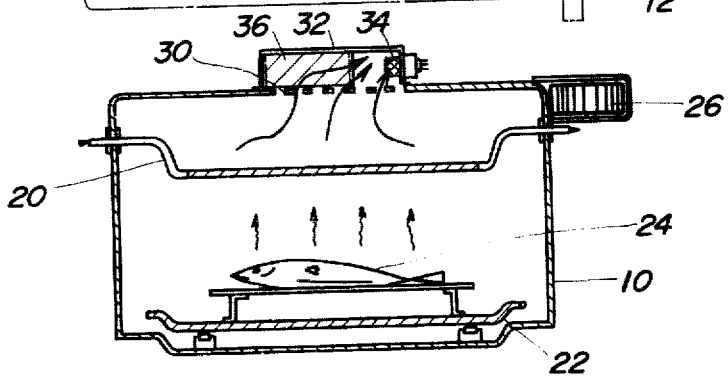
FIG. 2 is a sectional view of the combined microwave and electric heating cooking apparatus taken along line II—II of FIG. 1.

FIGS. 1 and 2 show an embodiment of a combined microwave and electric heating cooking apparatus.

The combined microwave and electric heating cooking apparatus mainly comprises an oven wall 10 for defining an oven cavity, and an oven door 12. A magnetron 14 is secured to the oven wall 10 for supplying the microwave energy into the oven cavity through a wave guide 16 and an energy supply outlet 18. Sheath heaters 20 are disposed in the oven cavity for conducting the electric heating cooking. A tray 22 is disposed at the bottom of the oven cavity for supporting a foodstuff 24 to be cooked in the oven cavity. A blower fan 26 is provided to cool the magnetron 14. The air flow generated by the blower fan 26 is introduced into the oven cavity through an air duct 28. The thus introduced air is exhausted from the oven cavity through exhaustion openings 30 which are formed in the upper wall of the oven cavity. An exhaustion duct 32 is secured to the upper wall of the oven cavity to cover the exhaustion openings 30. A gas sensor 34 is secured to the exhaustion duct 32 for detecting the concentration of the gas exhausted from the oven cavity. A guide plate 36 is disposed in the exhaustion duct 32 for directing the exhausted gas toward the gas sensor 34.

Figure 3:
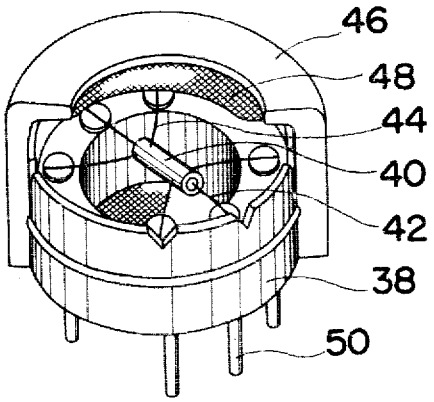
FIG. 3 is a perspective view of an embodiment of the gas sensor included in the combined microwave and electric heating cooking apparatus of FIG. 1.

FIG. 3 shows an embodiment of the gas sensor 34.

The gas sensor 34 mainly comprises a resin block 38, a sensor 40, a heater coil 42, lead wires 44, a cover 46 including a gauze 48, and an input/output socket 50. A preferred gas sensor is "TGS#813" manufactured by Figaro Engineering Inc.

Figure 4:
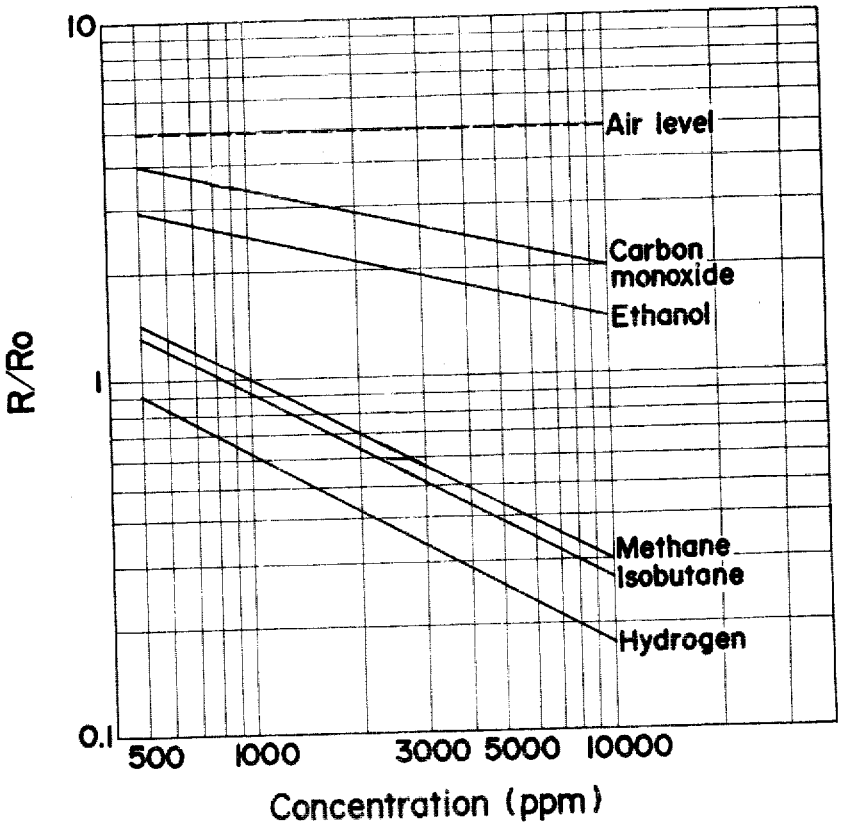
FIG. 4 is a chart showing the gas concentration response characteristic of the gas sensor of FIG. 3.

FIG. 4 shows the relationship between the gas concentration (along the abscissa axis) and the ratio of resistance ($R/R_o$) of the sensor (along the ordinate axis), wherein "$R_o$" is the sensor resistance in air containing 1000 ppm of Methane, and "R" is the sensor resistance at different concentrations of gases. As shown in FIG. 4, various reducing gases are shown, such as ethanol, methane, isobutane, carbon monoxide and hydrogen.

The present invention utilizes the above variations of the sensor resistance for determining the completion of the cooking.

Figure 5:
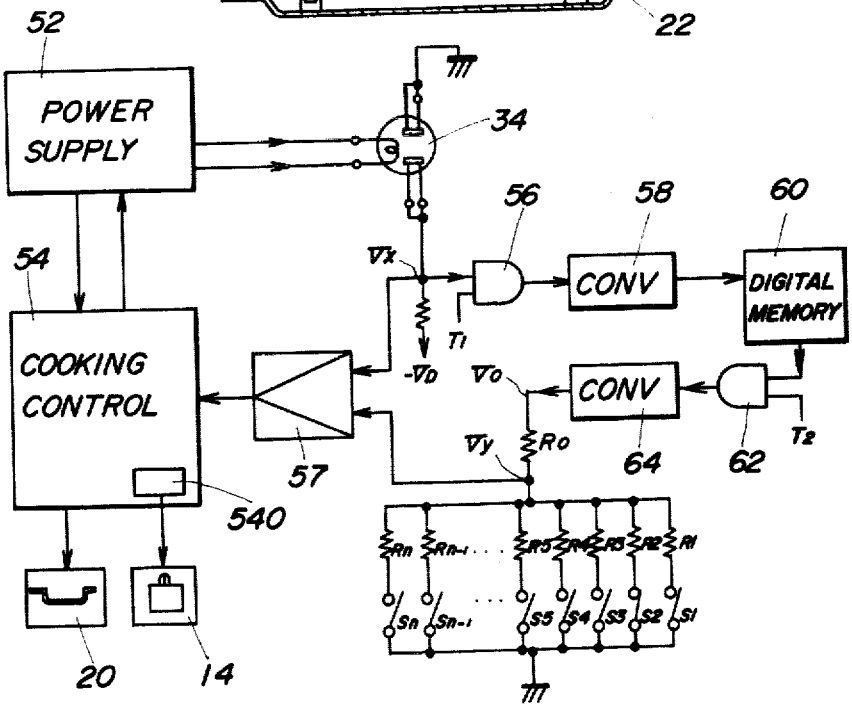
FIG. 5 is a block diagram of an embodiment of a control circuit of the present invention.

FIG. 5 shows an embodiment of a control circuit of the present invention, which responds to the gas sensor output.

The control circuit mainly comprises a power supply circuit 52, and a cooking control circuit 54 for controlling the operations of the magnetron 14 and the sheath heaters 20. The output voltage signal $V_x$ of the gas sensor 34 is applied to one input terminals of an AND gate 56 and a coincidence detection circuit 57. As already discussed above, the output voltage signal $V_x$ varies in response to the concentration of the gas exhausted from the oven cavity.

The control circuit includes an initial condition setting means comprising an analog-to-digital converter 58, a digital memory 60, and an AND gate 62 which is controlled by a timing signal $T_2$, and a digital-to-analog converter 64. More specifically, the output voltage signal $V_x$ of the gas sensor 34 is introduced into the analog-to-digital converter 58 through the AND gate 56 at a timing of a timing signal $T_1$ for determining the initial reference level. The thus introduced reference voltage signal is converted into a digital value by the analog-to-digital converter 58, and memorized in the digital memory 60. The thus stored reference value is continuously applied to the digital-to-analog converter 64 through the AND gate 62 for providing a reference voltage signal $V_o$.

The control circuit further includes a plurality of manual selection switches $S_1, S_2, \ldots S_n$ for instructing the kind of foodstuff to be cooked. For example, the selection switch $S_1$ is for warming "SAKE", the selection switch $S_2$ is for browning the fish, the selection switch $S_3$ is for baking the cake, etc. Resistors $R_1, R_2, \ldots, R_n$ are connected to each of the manual selection switches $S_1, S_2, \ldots, S_n$. The resistance value of each of the resistors $R_1, R_2, \ldots R_n$ is determined through experimentation so that a divided voltage level $$V_y\left( = V_o \times \frac{R_i}{R_o + R_i}\right.;$$

where $i = 1,2, \ldots n$) represents a desired voltage level at which the cooking should be terminated.

Operation of the control circuit of FIG. 5 will be described in detail with reference to FIG. 6.

When the cook start switch is actuated, only the blower fan 26 is energized to clean the air in the oven cavity. Sixteen second (16 sec) later, the timing signal $T_1$ is developed to set the initial reference level. It will be clear from FIG. 6 that the output voltage signal $V_x$ of the gas sensor 34 gradually reduces while only the blower fan 26 is energized. Thereafter, the cooking control circuit 54 activates the magnetron 14. In this way, the digital value corresponding to the reference voltage signal $V_o$ is stored in the digital memory 60. The timing signal $T_2$ is continuously developed after, for example, 30 sec. from the actuation of the cook start switch to develop the reference voltage signal $V_o$ through the digital-to-analog converter 64.

The cooking control circuit 54 includes a cooking mode selector 540 for changing the cooking mode between the microwave cooking mode and the electric heating cooking mode. In a preferred form, the cooking is first performed by the microwave cooking mode for, for example, three minutes and, then, by the electric heating cooking mode. In another preferred form, the cooking is first performed by the microwave generation and, then, by the electric heating when the gas sensor output reaches a preselected value.

Figure 6:
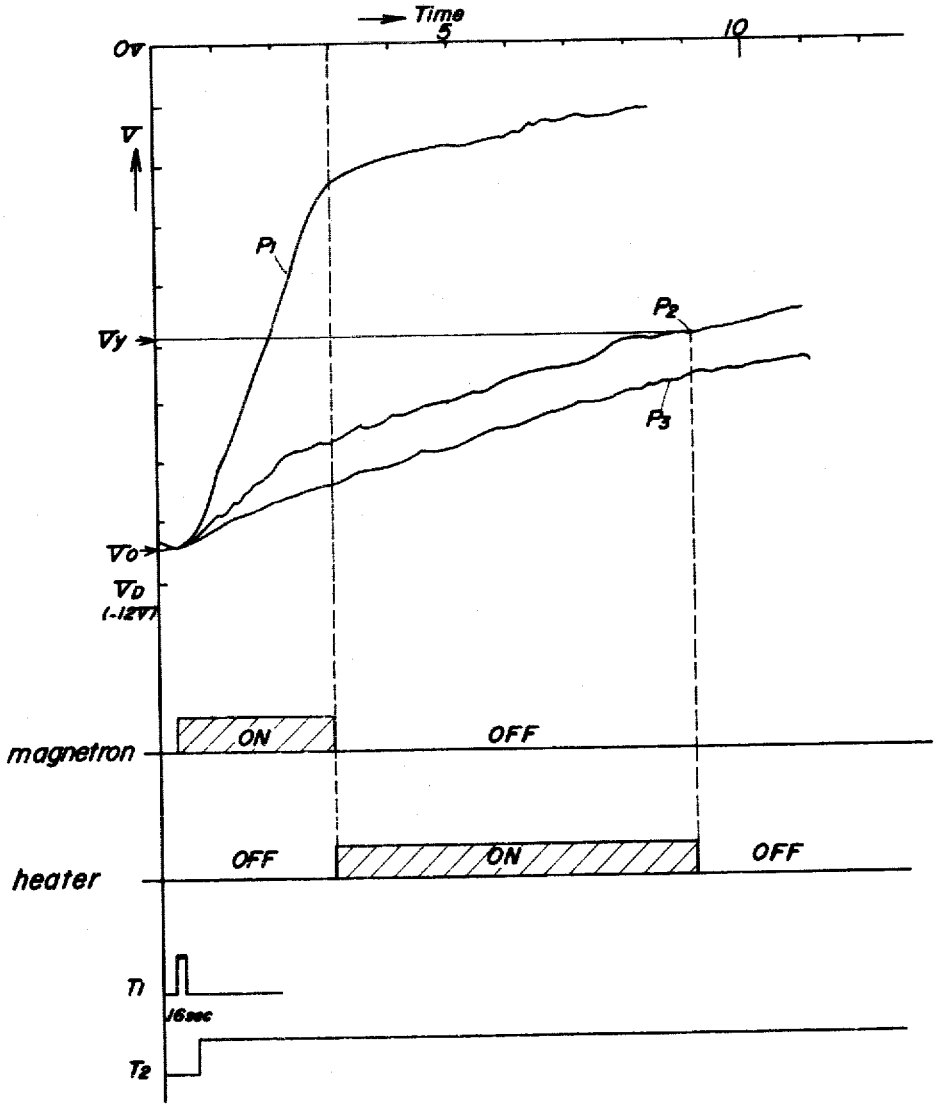
FIG. 6 is a time chart for explaining the operation mode of the control circuit of FIG. 5.

In FIG. 6, a curve $P_1$ represents output voltage signal $V_x$ when "SAKE" is warmed in the oven cavity.

Another curve $P_2$ represents the output voltage signal $V_x$ when the fish is browning in the oven cavity, and still another curve $P_3$ represents the output voltage signal $V_x$ when the cake is baked in the oven cavity.

Now assume that the fish is desired to be browned, and the manual selection switch $S_2$ is closed. The divided voltage level $$V_y\left( = V_o \times \frac{R_2}{R_0 + R_2}\right)$$

is continuously applied to the other input terminal of the coincidence detection circuit 57. When the output voltage signal $V_x$ (the curve $P_2$) becomes identical with the level $V_y$, the coincidence detection circuit 57 develops the detection output, whereby the cooking control circuit 54 deenergizes the sheath heater 20 to terminate the cooking.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A cooking apparatus comprising:

oven cavity means for receiving a foodstuff to be cooked;

cooking energy source means for conducting a cooking operation on said foodstuff disposed in said oven cavity means, said foodstuff producing a reducing gas in amounts representative of the cooked state thereof;

gas sensor means responsive to the presence of said reducing gas generated from said foodstuff, for providing an output signal representative of the concentration of said reducing gas in said oven cavity;

control circuit means for controlling the operation of said cooking energy source means as a function of said concentration of reducing gas, said control circuit comprising:

reference means for providing a reference signal of a selected value;

comparing means for comparing said output signal from said gas sensor means with said reference signal; selection means for selecting said reference signal in accordance with the kind of foodstuff to be cooked; and control signal developing means responsive to said comparing means for deenergizing said cooking energy source means when a corresponding value of said output signal derived from said gas sensor means reaches said preselected value of said reference signal.

2. The cooking apparatus of claim 1, further comprising storing means for storing an initial corresponding value level of said output signal derived from said gas sensor means, determinative of a desired cooking termination temperature; and wherein said selection means comprises a voltage divider means for developing a reference voltage signal representing the said initial corresponding value level to be stored in said storing means and comprising said reference signal.

3. The cooking apparatus of claim 2, wherein said storing means comprises:

gate circuit means for developing said output signal from said gas sensor means at a desired timing;

analog-to-digital converter means for developing a digital value signal in response to said output signal from said gate circuit means;

digital memory means for storing said digital value signal; and digital-to-analog converter means for developing a reference voltage signal corresonding to said digital value signal stored in said digital memory means, said reference voltage signal representing said initial corresponding value level of said output signal derived from said gas sensor means.

4. The cooking apparatus of claim 2 or 3, wherein said selection means comprises;

a plurality of selection switches; and a plurality of resistors connected to each of said plurality of selection switches for determining division ratios of said voltage dividing means.

5. The cooking apparatus of claim 1, 2 or 3, wherein said cooking apparatus comprises a microwave oven and wherein said cooking energy source means comprises a magnetron for conducting microwave cooking in said microwave oven.

6. The cooking apparatus of claim 1, 2 or 3, wherein said cooking energy source comprises a sheath heater disposed in said oven cavity means.

7. The cooking apparatus of claims 1 or 3, wherein said reducing gases produced by said foodstuff include organic gases.

8. The cooking apparatus of claim 7, wherein said organic gases belong to the group consisting of Ethanol, Methane and Isobutane.

9. The cooking apparatus of claims 1 or 3 wherein said reducing gas produced by said foodstuff belongs to the group consisting of Carbon Monoxide, Ethanol, Methane, Isobutane, and Hydrogen.

10. The invention of either of claims 1, 2 or 3 wherein said gas sensor means comprises a variable resistance means for providing a resistance value representative of said concentration of said reducing gas.

* * * * *